US005386771A

United States Patent [19]

McCartney et al.

[11] Patent Number: 5,386,771

[45] Date of Patent: Feb. 7, 1995

[54] DISPOSABLE UNITARY DAMPENING ROLLER

[75] Inventors: David J. McCartney, 26A Worlds Fair Dr., Somerset, N.J. 08873; Anthony Sorresso, West Babylon, N.Y.

[73] Assignee: David J. McCartney, Somerset, N.J.

[21] Appl. No.: 144,837

[22] Filed: Oct. 28, 1993

[51] Int. Cl.[6] ..... B41L 25/18

[52] U.S. Cl. ..... 101/148; 492/49

[58] Field of Search ..... 101/148, 348, 376; 492/16, 29, 49, 52

[56] References Cited

U.S. PATENT DOCUMENTS

| | | | |
|---|---|---|---|
| 2,966,724 | 1/1961 | Swope | 101/348 |
| 3,919,754 | 11/1975 | Sorresso | 101/147 |
| 4,759,284 | 7/1988 | Haggard et al. | 101/148 |
| 4,838,046 | 6/1989 | Yasukawa | 101/148 |
| 5,206,992 | 5/1993 | Carlson et al. | 101/376 |

*Primary Examiner*—Edgar S. Burr
*Assistant Examiner*—Stephen R. Funk
*Attorney, Agent, or Firm*—Henry I. Schanzer

[57] ABSTRACT

A low cost, disposable, unitized dampening roller/-dampening cover component consisting of a hollow tube on which is fixedly bonded a resilient layer and with a moisture absorbent cover fixedly bonded on the resilient layer. The tube is fitted with supportive injection molded end caps for mounting the roller/cover component as an integral component on a lithographic press. This all in one construction allows for fast and easy changing of dampening covers.

6 Claims, 4 Drawing Sheets

DISPOSABLE UNITARY DAMPENING ROLLER

FIELD OF INVENTION

This invention relates to dampening rollers and dampening covers which find use in offset printing presses. More particularly, the present invention relates to a unitized disposable roller and cover combination which is easy to replace and which can be manufactured at low cost.

BACKGROUND OF THE INVENTION

Offset printing presses operate under the principle that water and oil do not mix. A flexible plate containing an image to be printed is mounted on a drum also referred to as a press or plate cylinder. FIGS. 1 and 2 show a simplified view of rollers used to apply "water" and "ink" to an "image" plate mounted on a plate cylinder or drum 11. A first series of ink rollers 22 to 30 are coupled between an ink reservoir 21 and the plate cylinder 11 and are designed to make contact with the plate 11, with the end rollers (e.g., 29, 30) distributing ink to the imaged areas. A second series of rollers 32 to 35 are coupled between a reservoir 31 containing a water solution and the plate cylinder 11. The last roller 35, also denoted as a "water form roller", makes contact with plate cylinder 11, distributing a thin film of water or chemical solution (fountain solution) to the non-image areas of plate 11. This "dampening" action ( i.e., the application of a water solution to the plate) prevents the ink ("oil") from mixing or adhering to the non-image areas of the flexible image plate.

Traditionally one or more of the dampening rollers are covered with a paper or fabric material having absorbent properties to allow for the rapid and even transfer of water from the fountain or pan to the printing plate. The construction of the cover may be of cotton, rayon, or any number of other fabrics or paper substrates capable of wicking fountain solutions. This dampening material has a limited useful life that is measured in weeks, days, or even hours depending on a number of operational factors. Most commonly, the fabric or paper is eventually worn out by contact with the printing plate or becomes impregnated with ink solids which interfere with the balanced transfer of fountain solution. Soiled, contaminated, or exhausted covers must be manually stripped from the roller and replaced.

Conventionally, it has been the practice to remove a worn out dampening cover from a roller by cutting it with a sharp knife or blade, a practice which often results in damage to the roller, while risking the safety of the individual doing the cutting. Mounting a new cover on the roller is a time consuming task that involves forcing the cover over the roller surface. If the new cover has not been positioned properly so that it is centered on the roller, it must be removed and the process repeated until the distribution of the material is balanced. Because a taut fit around the circumference is essential to the proper rotation and operation of the roller, the mounting of new covers is an arduous task, requiring substantial physical effort to overcome the resistance of the closely matched outside diameter of the roller and the inside diameter of the dampening material.

The ends of the material must be secured to the roller ends to prevent any lateral movement. This is most commonly achieved through the use of drawstrings if so provided by the manufacturer of the dampening cover. These draw strings must be pulled tight over the two lateral ends of the roller and tied in a secure knot. If such retention devices are not provided, the user must carefully sew the cover ends using a needle and thread.

Some dampening covers have a shrinkable yarn imbedded in the construction of the material which is activated upon being wetted with water. This shrinkage is intended to provide a tight and secure fit through circumferential compression, eliminating the need for drawstrings or sewing. Due to the torque and high speeds encountered during the rotation of the dampening roller, this constriction mounting method often fails to provide adequate adhesion to the roller, resulting in the cover "walking" or sliding off the roller. Also, the shrinkage is very often irregular, resulting in an uneven dampening surface and impaired water transfer.

Dampening rollers are also often subject to contact with mechanical linkages, such as drive collars and/or gears, which often shear the cover ends and cut the drawstrings, stitching, or other containment devices. This causes the cover to break free and move side to side, resulting in a loss of the dampening action and the need for immediate replacement.

Other factors often necessitate the removal and replacement of dampening covers. The rubber rollers used to support them often swell over time due to absorption of chemicals. This expansion most often takes place at the roller ends where caustic compounds found in inks, solvents, and dampening solutions can easily permeate the exposed rubber. Once swelled, the roller is no longer of consistent diameter and can not provide even contact with the image plate. Unbalanced dampening action results and the dampening cover must be removed so the roller can be reground to uniform thickness or replaced.

Regardless of the method used to mount and secure the dampening material, it is a laborious and time consuming task which is most often performed by the pressperson, a highly paid technical position. The result is that the cost to change a cover is often substantially more than the cost of the material itself. The traditional cover changing process may require 15 to 30 minutes on average.

It is an object of the invention to provide a unitary disposable component comprising the integral combination of a dampening roller and cover which can be easily and rapidly replaced (e.g., in less than 30 seconds) and which can be manufactured economically.

The physical composition of dampening rollers has been limited to natural or synthetic rubber in order to provide a resilient mounting surface for the dampening cover. The durometer reading, a measure of a rubber surface's resiliency, is typically specified as a value between 23 and 29 for dampening rollers. This pliant rating provides the shock absorbent cushioning or "give" required to maintain even and consistent plate-to-dampening cover contact. Inconsistencies in the thickness of the dampening material as well as plus or minus variances in the concentric trueness of the roller itself require the compensatory spring action of a resilient material such as rubber. The yielding properties of the rubber also absorb bounce or vibration encountered during high speed rotation.

In consideration of the inconsistencies in the thickness that result during the manufacturing of covers and rollers, it should be noted that in actual use the pressure setting applied between the dampening cover (e.g., assembly 35 in FIGS. 1 and 2, herein) and the plate 11 is intentionally increased beyond the point of initial contact as compensation. This exaggerated pressure setting also provides a slight squeegee effect assuring the complete release of the fountain solution onto the plate.

Consideration must also be given to the fact that as the dampening roller rotates over the surface of the plate, it passes over a gap or indentation 13 in the supportive plate cylinder. This gap 13, which normally is about 2 to 4 inches in width, is a necessary indent which provides a point of attachment for the head and tail of the flexible image plate. As the dampening roller passes over the beginning of gap 13, contact with the cylinder and plate is momentarily lost. As the cylinder and roller continue to rotate contact is once again made with the cylinder and plate surface. It is at this point that the roller/cover assembly is subjected to sudden impact and stress as the resumed contact compresses the dampening cover/roller assembly. The shock absorption provided by the rubber construction of the roller attenuates and dissipates the impact which would normally be transferred to the bearings, shaft, journal, or other supportive structures, causing wear and/or damage to the dampening roller and eventually to the press itself.

In a former method, as described in U.S. Pat. No. 2,966,724, the subject matter of which is incorporated herein by reference, a disposable roller comprised of a thick core is also prefitted with a dampening covering. This concept calls for the addition of metal or plastic bearings to provide precise support and rotation of the roller. The thick, heavy, construction of the tube adds to the weight and cost of the roller and the use of bearing assemblies also adds substantially to the cost and complexity of the system, negating any claim as a low cost, disposable concept. Additionally, there is no cushioning effect provided by the design, as the dampening material is adhered directly to a non-resilient solid roller.

Another approach is to be found in U.S. Pat. No. 3,919,754, the subject matter of which is incorporated herein by reference, in which a multiple component premounted roller/dampening cover assembly is introduced. FIG. 6 of the 3,919,754 patent shows a three part disposable cover comprising an inner core, a surrounding tube of a resilient material, and an outer sleeve of water absorbent material. In use, the three part cover assembly is mounted on a supportive roller (i.e., item 10 shown in FIG. 2 of the '754 patent) of the printing press and held in place by removable, machined end caps containing inset metal bearing support assemblies. The patented design necessitates additional down time during cover changes, as the end caps must be removed and then replaced each time a premounted sleeve is changed. The use of metal machined parts adds substantially to the cost and complexity of the system. Additionally, the bearings are subject to wear requiring replacement as in a traditional roller and any mishandling of the supportive metal components which might result in a burr, dent, or abrasion could necessitate replacement.

It is, therefore, an object of the present invention to provide a unitary disposable component comprising an integral dampening roller/dampening cover assembly that is simple in construction, low in cost, light in weight, and which can be quickly and easily mounted and removed as necessary.

It is another object of the present invention to provide a stable and precise support for a dampening roller assembly without the need for conventional bearings, bushings, or other supportive devices as required in previous designs.

It is still a further object of the present invention to allow for variation in the formulation, construction, and thickness of different dampening materials so that the cover assembly is not restricted to a singular brand, physical composition, or material type.

Other objects and features of the present invention will become apparent from the following detailed description considered in connection with the accompanying drawings. It is understood, however, that the drawings are designed for the purposes of illustration only and not as a definition of the limits of the invention, for which reference should be made to the appending claims.

SUMMARY OF THE INVENTION

A disposable dampening roller comprises a flexible resilient layer fixedly bonded around an inner, rigid support tube and a cover of moisture absorbing material fixedly bonded to the flexible layer. End caps are fixedly secured to the support tube and include means for rigidly, but removably, mounting the roller on a press for enabling rotation of the roller.

BRIEF DESCRIPTION OF THE DRAWING

In the accompanying drawing like reference characters denote like components.

DETAILED DESCRIPTION OF THE INVENTION

Figure 1:
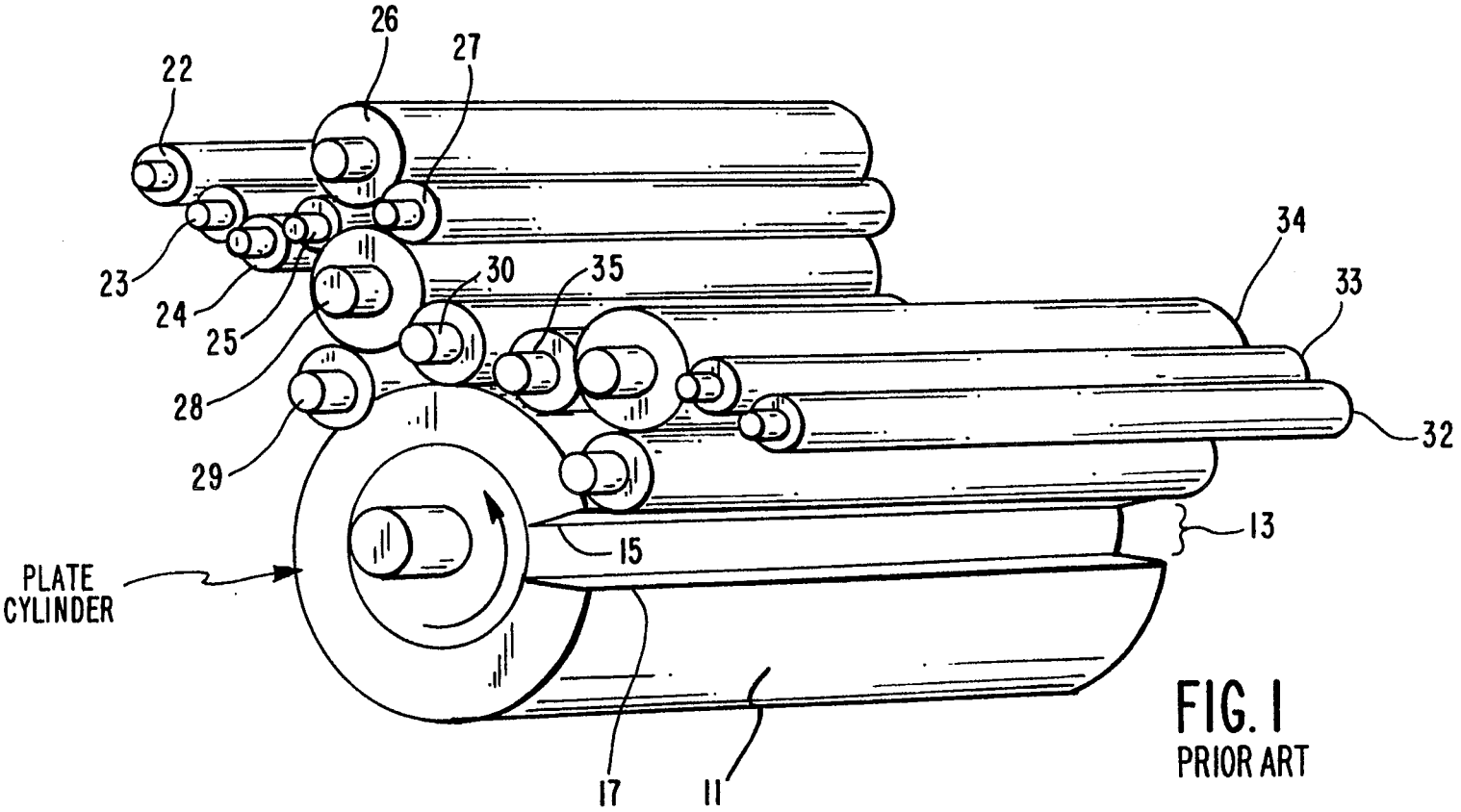
FIG. 1 PRIOR ART
FIG. 1 is an isometric view of a portion of a prior art lithographic machine.
Figure 2:
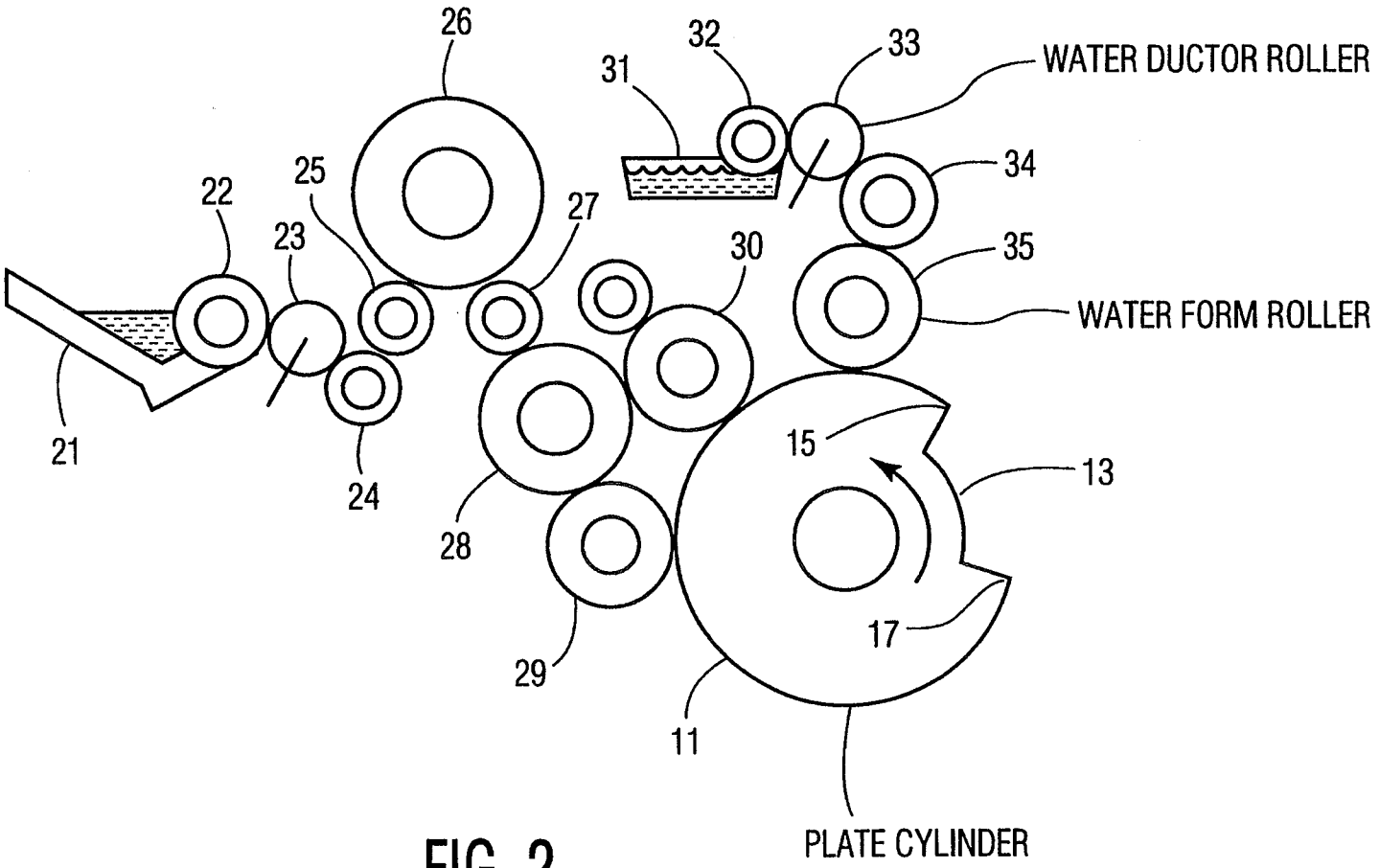
FIG. 2 PRIOR ART
FIG. 2 is a cross-section view of the portion of the prior art apparatus shown in FIG. 1.

FIGS. 1 and 2 show portions of a printing press with which the present invention has utility.

Referring to FIG. 1, there is shown a plate cylinder 11 on which is mounted a flexible image plate (not shown). The plate cylinder has an indentation 13 which functions to enable the image plate to be fixedly attached thereto. FIG. 1 shows ink rollers (22–30) used to apply an ink solution to the image plate and water rollers (32–35) which function to apply a water solution to an image plate mounted on the plate cylinder 11.

Referring to FIG. 2, there is shown a water pan 31 for storing a water solution to be applied via the various rollers to the image plate (not shown) on the plate cylinder 11. Also shown is a pan 21 for storing the ink to be applied via the rollers 22 to 30 to the image plate mounted on the plate cylinder 11.

For purpose of illustration, FIG. 2 shows a fountain roller 32, a ductor roller 33, an oscillator or distributor roller 34 and a dampening roller 35 also known as a water form roller. Roller 35 is referred to herein as the dampening roller and it is this roller, more than any others, which requires frequent changing. However, it should be appreciated that rollers embodying the invention can be used to form other rollers, such as roller 33, used in the lithographic equipment.

As noted above, when the plate cylinder 11 rotates counterclockwise, as shown in FIG. 2, each time the end portion 17 of plate cylinder 11 contacts roller 35 there is a substantial impact on roller 35. This substantial impact must be attenuated and the prior art uses rubber based rollers to absorb the shock. In rollers formed according to the invention, a resilient material is bonded on the roller.

Figure 3:
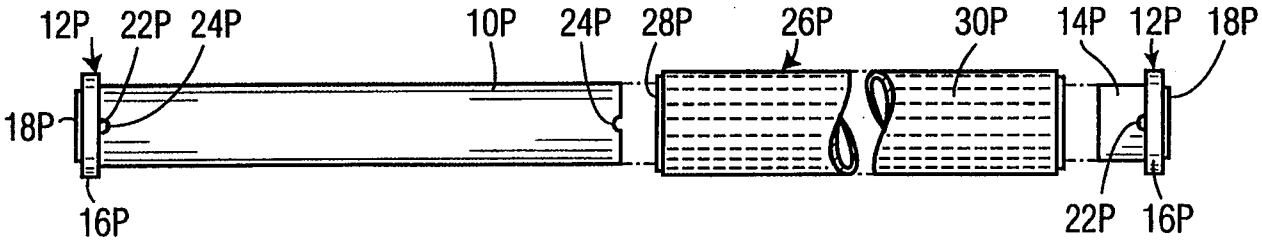
FIG. 3 PRIOR ART
FIG. 3 is a copy of FIG. 2 of U.S. Pat. No. 3,919,754 and is an exploded view of a roller assembly.

A dampening roller formed according to the present invention comprises a unitary roller assembly to be directly mounted on a shaft 100 of the press. This is in contrast to the roller assembly shown in FIGS. 2 and 6 of U.S. Pat. No. 3,919,754 in which the combination of a disposable cover and tube is mounted on a separate supportive press roller (see roller 10 in FIG. 2 of the patent, replicated as roller 10P of FIG. 3, herein). The inventive roller is not intended to be mounted on a supportive roller forming a part of the press itself. Rather, the dampening roller according to the invention includes, as an integral portion of the disposable roller assembly, a support tube 60 serving the functions of the supportive roller 10 and of the core 28 shown in FIG. 2 of U.S. Pat. No. 3,919,754 and reproduced as FIG. 3 herein.

Figure 5:
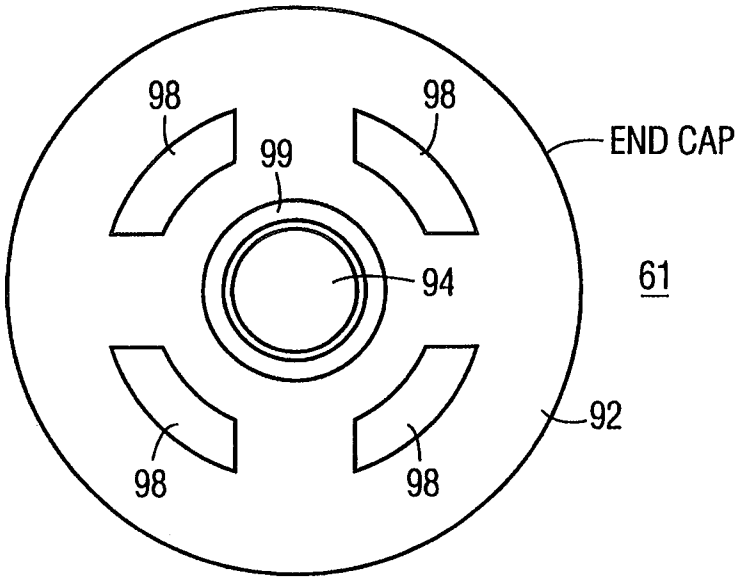
FIG. 5 is an end view of an end cap shown in FIG. 4.

Conventionally, as shown in FIGS. 2, 5 and 6 of U.S. Pat. No. 3,919,754, the disposable cover assemblies (28, 30 or 34, 36, 38) disclosed in patent 3,919,754 are mounted on and removed from a supportive roller (e.g., roller 10) with the whole assembly, including roller 10, being mounted on a press shaft 32.

In contrast thereto, in accordance with this invention, the inventive roller/cover assembly includes a unitary component comprising the combination 59 of a supportive tube, a resilient layer and a cover, with the entire combination 59 being disposable and the entire combination being mountable and/or removable as a single unit onto or from a shaft 100 of the press.

Figure 4:
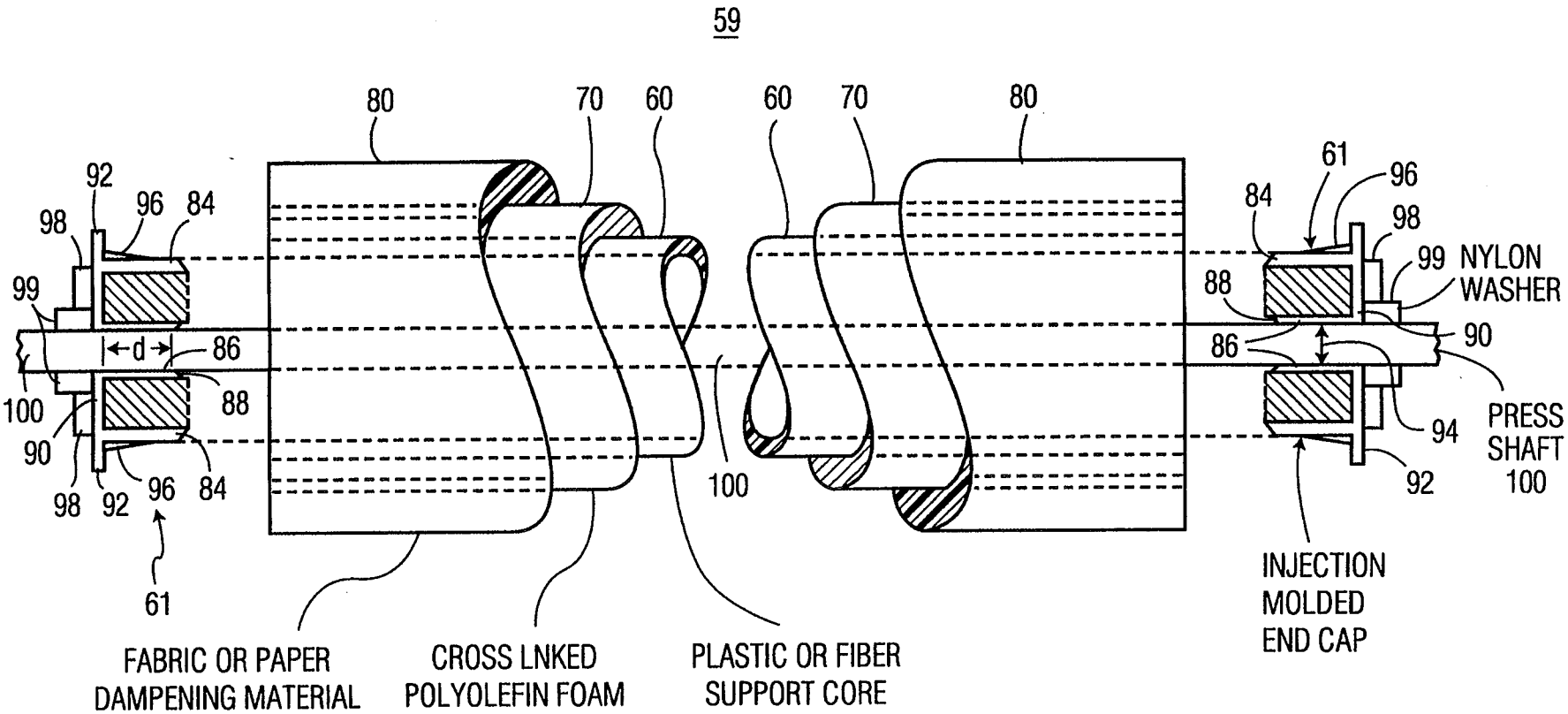
FIG. 4 is an exploded view, partially broken away and partially in section, of a roller assembly according to the present invention.

FIG. 4 shows a roller assembly 59 according to the present invention. The roller assembly 59 comprises a hollow cylindrical support or driving tube 60 which has each of its two opposite lateral ends fitted with one of a pair of end caps 61. Disposed on and bonded to the outer periphery of tube 60 is a cylindrical jacket or layer 70 formed of a resilient material. Disposed on and bonded to the outer periphery of resilient jacket 70 is a uniform layer or cover 80 of a moisture absorbent material.

A feature of the invention is the low cost of the disposable roller assemblies. Thus, in a preferred embodiment, the driving or support tube 60 is formed of a water proof, phenolic resin impregnated paper. In one embodiment, the specific material is spirally wound kraft tubing which is available from New England Paper Tube Co.

The resin impregnated paper is formable into hollow cylindrical form by known means. In one embodiment, the wall of the tube 60 is 0.09 inches thick and the inner diameter of the tube is 1.57 inches. The tube 60 is quite rigid and possesses great strength and mechanical rigidity. Thus, the disposable roller assembly can be directly mounted on a shaft 100 of the printing press and the roller assembly need not be mounted on a supportive roller of the press to provide mechanical support for the disposable assembly.

The support tube 60 of the assembly can be made of other inexpensive but strong materials, e.g., known plastics.

The purpose of the layer 70 of the assembly is to provide resiliency for absorption of mechanical shocks and also provide the "squeegee" effect discussed above. Thus, the layer 70 can be of rubber or the like. A preferred material for the layer 70 is a crosslinked polyolefin foam. Such a foam is commercially available in sheet form with quite good thickness dimension controls. In one embodiment, the layer used has a thickness of $\frac{1}{8}$ inch and a narrow strip thereof is spirally wound around the tube 60 to form a continuous layer. It is glued to the tube for rigid adherence.

The outer cover 80 of moisture absorbent material can be of a known material previously used in dampening rollers. A preferred material is knitted rayon.

As previously noted, a principal feature of the invention is that the disposable roller assembly comprises the entire rotatable member, mounted on shaft 100, used in the press for transferring water. Also, the roller assembly is quickly and easily mounted on, and removed from, the press. To this end, the end caps 61 are provided. The end caps 61 are integral portions of the assembly.

In a preferred embodiment, the end caps are made of plastic and are rigidly attached to the assembly by being press fitted within the ends of the inner tube 60. Also, for added strength, the end caps can also be glued to the tube 60.

As shown in FIGS. 4 and 5, each end cap 61, includes an outer, cylindrical wall 84 for engagement with the inner wall of the tube 60, and an inner cylindrical wall 86 having an inner end 88 and an outer end 90, with wall 86 being concentric with the outer wall 84. The outer end 90 of the inner wall extends through a radially extending flange 92 forming an outer, end surface of the end caps and provides a central opening 94 through the flange. When disposed within the tube 60, the inside surface 96 of the flange 92, firmly engages the end of the tube 60, and is tapered to provide increasing frictional gripping as the end caps are inserted into tube 60.

The exterior side of the end caps include extensions 98 which function as clutch lugs for engagement with a mating part to drive the roller/cover assembly, if necessary. The shaft 100 is designed to slide through the opening 94 with the inner cylindrical wall 86 surrounding and resting on shaft 100. The inventive roller/cover assembly is thus mounted on shaft 100 which supports the assembly. The design of wall 86 is intended to eliminate the need for metal bearing assemblies, bushings, or other adjunct mechanical fixtures normally associated with friction abating qualities. By increasing the length "d" of the cylindrical wall 86, each end cap is able to provide stable support for the entire assembly while avoiding wear and damage to the end caps and/or the roller shaft. Friction and wear between the cylindrical wall 86 and the roller shaft is effectively dissipated by spreading the point of contact over the increased surface area of the cylindrical wall. In addition, the end cap material may be selected to be ABS plastic which provides strong and yet somewhat yielding properties. If any wear is experienced as the result of friction, the plastic surface, with its softer composition, will display the wear first, reducing, if not eliminating, the possibility of damage to the hardened steel roller shaft.

The potential problem of lateral friction and wear is addressed through the addition of a nylon plastic washer 99 (see FIGS. 4 and 5) which is either bonded to or inset into the exterior end of end cap 61 and which in one embodiment was made 0.032 inches thick. Considering the high speed rotation of the roller and the natural tendency for lateral or side-to-side movement, a friction and/or heat resistant barrier (e.g., washer 99) is used to abate wear on the ends of the caps. Nylon provides these necessary qualities.

Both ABS plastic and nylon provide beneficial qualities at low cost, and are therefore supportive of the goal of manufacturing a low cost disposable system.

The inventive roller assembly solves various ones of the aforedescribed problems of the prior art. Thus, in comparison with the roller assemblies shown in U.S. Pat. No. 2,966,724, the present roller assemblies are basically hollow, hence can be of far less weight than the assemblies disclosed in the patent. Also, contrary to the assemblies shown in the '724 patent, the inventive roller assemblies include a layer of resilient material between the inner support roller, and the outer layer of water absorbent material. As previously noted, such resilient layer is of great significance for absorbing mechanical shocks arising during use of the press and greatly extends the life of the roller assembly.

In comparison with the roller assemblies shown in U.S. Pat. No. 3,919,754, the inventive disposable assemblies comprise the entire water dampening roller mechanism, including the end cap bearing members for mounting the roller assembly on the supportive shaft 100 of the printing press. Thus, both the mounting and removal of the inventive roller assemblies is far easier and quicker than with the assemblies shown in the patent. Also, because the end cap bearing members of the inventive assemblies are simple plastic molded members, rather than the machined metal bearing members (item 12P in FIG. 3 herein) shown in the patent, much less expensive bearing members need be provided.

For purpose of claiming the inventive subject matter, such terms as "bonding", "fixedly assembled" and the like are intended to mean that the inventive roller assembly is an integral component, including all the parts thereof firmly attached thereto, enabling simple handling, shipping, mounting and demounting of the assemblies from the printing press. Obviously, however, this definition does not exclude the possibility of different components of the assemblies being manufactured in different places for final assembly when needed. For example, it is contemplated that the end caps can be manufactured and shipped separately from the multilayer rollers. Then, at any time prior to mounting on a printing press, the end caps can be press fitted into the ends of the inner tube 60 to complete the assembly. Likewise, after removal of the integral roller assembly from the printing press, the end caps, if not damaged, can be salvaged for use with other rollers.

What is claimed is:

1. A unitary, disposable dampening roller assembly for use in a lithographic press assembly comprising:

a rigid cylindrical and relatively thin-walled support tube having an inner surface and an outer surface; the difference between the inner and outer surfaces defining the thickness of the wall of the tube, and the thickness of the wall of the tube being no more than one tenth the inner diameter of the cylindrical support tube;

a layer of resilient material fixedly bonded to the outer surface of said support tube;

a layer of moisture absorbent material fixedly bonded to an outer surface of said layer of resilient material; and a pair of end caps, one end cap being fixedly mounted within each end of said support tube, each end cap having a radially extending flange engaging a respective end of said support tube, and said end caps including means for removably mounting the assembly on a rotatable axle of a lithographic press.

2. The roller assembly of claim 1 wherein said rigid support tube is formed of phenolic resin impregnated spirally wound tubing.

3. The roller assembly of claim 1 wherein said resilient material is comprised of a foam glued onto said rigid support tube.

4. The combination as claimed in claim 1, wherein said resilient layer has a thickness which is approximately equal to the thickness of the wall of the support tube.

5. The combination as claimed in claim 4, wherein said resilient layer is approximately one eighth ($\frac{1}{8}$) of an inch thick.

6. A unitary, disposable dampening roller assembly comprising:

a core, cylindrical rigid support tube having an inner surface with an internal diameter and having an outer surface with an outer diameter; the outer diameter being not more than ten percent greater than the internal diameter, whereby said support tube has a relatively thin wall and is relatively light weight for enabling the easy insertion and removal of said support tube in a lithographic press;

a cylindrical jacket of resilient material adhesively attached to the outer surface of said support tube;

a seamless cylindrical jacket formed of moisture absorbent material adhesively attached to an outer periphery of said cylindrical jacket of resilient material; and a pair of end caps, one end cap being mounted within each end of said support tube, each end cap having a short hollow tube body with an outside diameter and surface complimentary with the inner surface of said support tube for mounting snugly within said support tube, each end cap also having a flange for contacting an end of said support tube and said flange including means for removably mounting the assembly on a rotatable axle of a lithographic press.

* * * * *